US011663977B2

(12) United States Patent
Park et al.

(10) Patent No.: US 11,663,977 B2
(45) Date of Patent: May 30, 2023

(54) DISPLAY DEVICE

(71) Applicant: Samsung Display Co., Ltd., Yongin-Si (KR)

(72) Inventors: Se Hyuk Park, Yongin-si (KR); Hong Soo Kim, Yongin-si (KR); Jin Young Roh, Yongin-si (KR); Hyo Jin Lee, Yongin-si (KR); Jae Keun Lim, Yongin-si (KR)

(73) Assignee: Samsung Display Co., Lid., Yongin-si (KR)

( * ) Notice: Subject to any disclaimer, the term of this patent is extended or adjusted under 35 U.S.C. 154(b) by 0 days.

(21) Appl. No.: 17/519,625

(22) Filed: Nov. 5, 2021

(65) Prior Publication Data

US 2022/0319435 A1 Oct. 6, 2022

(30) Foreign Application Priority Data

Mar. 30, 2021 (KR) ..... 10-2021-0041338

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2300/0452* (2013.01); *G09G 2310/0278* (2013.01); *G09G 2320/0673* (2013.01)

(58) Field of Classification Search
CPC ..... G09G 3/3266; G09G 3/3275; G09G 2310/0297; G09G 2310/04; G09G 2310/0278; G09G 2310/0235; G09G 2300/0452; G09G 2320/10; G09G 2320/103; G09G 2320/106; G09G 2320/0673; G09G 2330/022; G09G 2340/04; G09G 2340/0407; G09G 2340/0414; G09G 2340/0421; G09G 2340/0428; G09G 2340/0435
See application file for complete search history.

(56) References Cited

U.S. PATENT DOCUMENTS 11,501,678 B2 11/2022 Kim et al.
2005/0275610 A1* 12/2005 Roh ..... G09G 3/3614 345/88
2013/0278572 A1 10/2013 Lee et al.
(Continued)

FOREIGN PATENT DOCUMENTS

EP 3832631 A1 6/2021
KR 10-2017-0040600 A 4/2017
(Continued)

*Primary Examiner* — Nitin Patel
*Assistant Examiner* — Amen W Bogale
(74) *Attorney, Agent, or Firm* — Innovation Counsel LLP

(57) ABSTRACT

The present disclosure provides a display device that controls output of a scan signal, conversion of image data, and output of a data signal in response to partial scan driving. The display device includes a display panel driven in one of a first mode and a second mode, a scan driver sequentially supplying a scan signal for writing data in the first mode, a controller generating image data in which input image data is rearranged based on the first mode or the second mode, and a data driver converting the image data into data signals and supplying the data signals to output channels.

17 Claims, 15 Drawing Sheets

(56) References Cited

U.S. PATENT DOCUMENTS

| | | | | |
|---|---|---|---|---|
| 2016/0322012 | A1* | 11/2016 | Oh | G09G 3/3648 |
| 2020/0020296 | A1* | 1/2020 | Kim | G09G 3/3696 |
| 2021/0043140 | A1* | 2/2021 | Roh | G09G 3/3258 |

FOREIGN PATENT DOCUMENTS

| | | | |
|---|---|---|---|
| KR | 10-2019-0136396 | A | 12/2019 |
| KR | 10-2070660 | B1 | 1/2020 |
| KR | 10-2020-0015870 | A | 2/2020 |
| KR | 10-2022-0136576 | A | 10/2022 |

* cited by examiner

FIG. 15

| MODE | FREQUENCY | PANEL | STV | CH1 DATA OUTPUT |
|---|---|---|---|---|
| MODE1 | 60Hz | No-mux | 110 | RBRB... |
| | | Demux | 111 | RBBR... |
| MODE2 | 30Hz | No-mux | 000 | RRRR... / BBBB... |
| | | Demux | 001 | RBRB... / BRBR... |
| | 20Hz | No-mux | 010 | RBRB... / BRBR... / RBRB... |
| | | Demux | 011 | RBBR... / BRRB... / RBBR... |
| | 15Hz | No-mux | 100 | RRRR... / BBBB... / RRRR... / BBBB... |
| | | Demux | 101 | RBRB... / BRBR... / RBRB... / BRBR... |

DISPLAY DEVICE

CROSS-REFERENCE TO RELATED APPLICATION

The application claims priority to and the benefit of Korean Patent Application No. 10-2021-0041338, filed Mar. 30, 2021, which is hereby incorporated by reference for all purposes as if fully set forth herein.

BACKGROUND

1. Field

The present disclosure relates to a display device, and more particularly, to a display device capable of controlling output of a scan signal, conversion of image data, and output of a data signal in response to partial scan driving.

2. Description of the Related Art

A display device includes a display panel including pixels and a driver driving the display panel. Each of the pixels emits light with a luminance corresponding to a data signal provided through a corresponding data line in response to a scan signal provided through a scan line.

In order to reduce power consumption of an electronic device and a display device, when low power is required, such as when displaying a static image, an image can be displayed by driving at a low frequency of less than 60 Hz. Thus, researches are being conducted to improve power consumption by varying a driving frequency according to a type of image, and to minimize deterioration in image quality when driving at the low frequency.

SUMMARY

An object of the present disclosure is to provide a display device that controls output of a scan signal, conversion of image data, and output of a data signal in response to partial scan driving.

However, objects of the present disclosure are not limited to the above-described object, and may be variously extended without departing from the spirit and scope of the present disclosure.

In order to achieve the object of the present disclosure, a display device according to embodiments of the present disclosure may include a display panel driven in one of a first mode displaying an image at a first frequency and a second mode displaying an image at a second frequency lower than the first frequency; a scan driver sequentially supplying a scan signal for writing data in the first mode to all pixel rows during a first frame corresponding to the first frequency; a controller generating image data in which input image data is rearranged based on the first mode or the second mode; and a data driver converting the image data into data signals and supplying the data signals to output channels. In the second mode, the scan driver may supply the scan signal to some pixel rows, respectively, during writing periods of a second frame corresponding to the second frequency, and stop supplying the scan signal during power saving periods of the second frame. Under the same input grayscale condition, a change in voltage of the data signals output to a first output channel among the output channels during the first frame and a change in voltage of the data signals output to the first output channel during the second frame may be different.

According to an embodiment, the controller may generate the image data according to an order in which the pixel rows are selected during the writing periods of the second mode.

According to an embodiment, the display device may further include a gamma generator providing a first gamma set corresponding to a first color, a second gamma set corresponding to a second color, and a third gamma set corresponding to a third color to the data driver.

According to an embodiment, the image data of the first frame mat be arranged in a first arrangement type, and the image data of the second frame may be arranged in a second arrangement type.

According to an embodiment, the data driver may apply the first to third gamma sets to the image data in correspondence with the first arrangement type in the first mode, and the data driver may apply the first to third gamma sets to the image data in correspondence with the second arrangement type in the second mode.

According to an embodiment, the data driver may stop outputting the data signals during the power saving periods.

According to an embodiment, each of the writing periods may be shorter than a period of the first frame.

According to an embodiment, the display panel may include a first pixel row in which a first pixel emitting light of a first color, a second pixel emitting light of a second color, a third pixel emitting light of a third color, and the second pixel are arranged in a first direction; and a second pixel row in which the third pixel, the second pixel, the first pixel, and the second pixel are arranged in the first direction. A pixel arrangement of the first pixel row and a pixel arrangement of the second pixel row may be alternately repeated in a second direction.

According to an embodiment, the writing periods may include first to k-th writing periods (where k is an integer greater than 1), and the power saving periods may include first to k-th power saving periods.

According to an embodiment, the scan driver may supply the scan signal to different pixel rows in each of the first to k-th writing periods.

According to an embodiment, an arrangement of the image data corresponding to the first writing period of the first output channel may be different from an arrangement of the image data corresponding to the second writing period of the first output channel.

According to an embodiment, under the same input grayscale condition, a change in voltage of the data signals output to the first output channel in the first writing period may be different from a change in voltage of the data signals output to the first output channel in the second writing period.

According to an embodiment, a second output channel among the output channels may be connected to the second pixel, and the data signals corresponding to the second color may be output to the second output channel during the period of the first frame and the writing periods.

According to an embodiment, the display device may further include a data divider connecting the output channels and data lines connected to pixel columns of the display panel to 1:j (wherein j is an integer greater than 1).

According to an embodiment, the data divider may alternately supply the data signals supplied from the first output channel to a first data line and a third data line, and the data divider may alternately supply the data signals supplied from the second output channel to a second data line and a fourth data line.

According to an embodiment, the controller may include a static image determiner detecting a static image by comparing the input image data of successive frames; a frequency determiner activating the second mode based on a detected static image and determining the second frequency; a partial scan controller generating a scan control signal and a data control signal for controlling the scan driver and the data driver in the writing periods and the power saving periods based on the second frequency; and a data rearranger rearranging the input image data based on the second frequency.

According to an embodiment, the controller may further include a storage storing option values including structure information and frequency information of the display panel. The frequency determiner may determine the second frequency based on a value loaded from the storage, and the data rearranger may rearrange the input image data based on the value loaded from the storage and the second frequency.

According to an embodiment, the partial scan controller may generate configuration data for determining an operation option of the data driver based on the second frequency and the structure information of the display panel, and the configuration data may include arrangement information and gamma application information of the image data corresponding to the second frequency.

BRIEF DESCRIPTION OF THE DRAWINGS

The accompanying drawings, which are included to provide a further understanding of the present disclosure, and are incorporated in and constitute a part of this specification, illustrate example embodiments of the present disclosure, and, together with the description, serve to explain principles of the present disclosure.

FIG. 15 is a diagram illustrating an example of data outputs corresponding to setting values included in a storage of FIG. 14.

DETAILED DESCRIPTION OF THE ILLUSTRATED EMBODIMENTS

Figure 1:
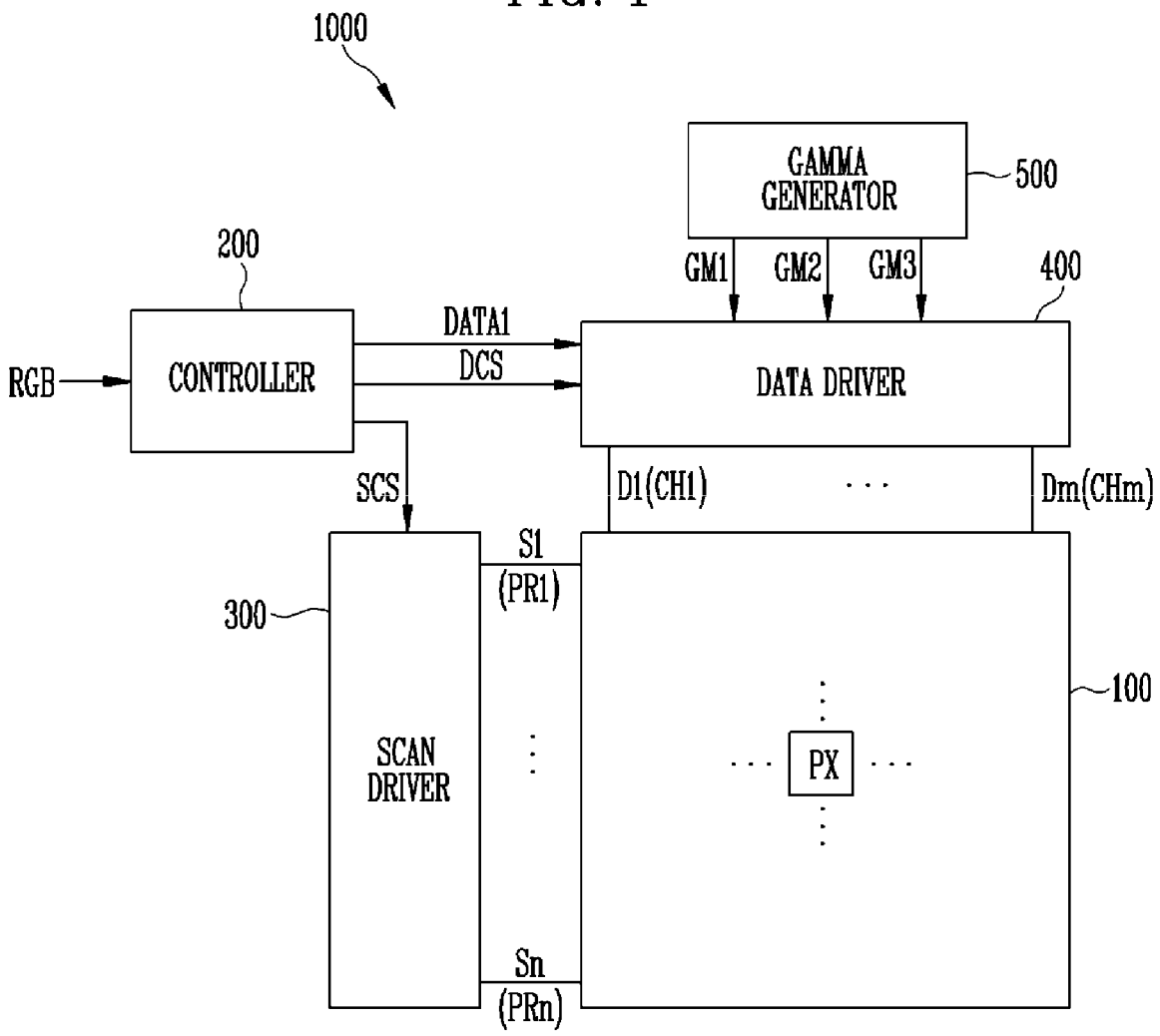
FIG. 1 is a block diagram illustrating a display device according to embodiments of the present disclosure.

Hereinafter, preferred embodiments of the present disclosure will be described in more detail with reference to the accompanying drawings. The same reference numerals are used for the same elements in the drawings, and duplicate descriptions for the same elements are omitted.

FIG. 1 is a block diagram illustrating a display device according to embodiments of the present disclosure.

Referring to FIG. 1, a display device 1000 may include a display panel 100, a controller 200, a scan driver 300, and a data driver 400. The display device 1000 may further include a gamma generator 500.

The display device 1000 may be a self-light emitting display device including a plurality of self-light emitting elements. For example, the display device 1000 may be an organic light emitting display device including organic light emitting elements, a display device including inorganic light emitting elements, or a display device including light emitting elements composed of a combination of inorganic and organic materials. However, this is an example, and the display device 1000 may be implemented as a liquid crystal display device, a plasma display device, a quantum dot display device, or the like.

The display device 1000 may be a flat panel display device, a flexible display device, a curved display device, a foldable display device, or a bendable display device. In addition, the display device 1000 may be applied to a transparent display device, a head-mounted display device, a wearable display device, or the like.

The display panel 100 may include scan lines S1 to Sn, data lines D1 to Dm, and a plurality of pixels PX, where n and m may be integers greater than 1. The pixels PX may be electrically connected to the data lines D1 to Dm and the scan lines S1 to Sn. Pixels (or pixel lines) that are simultaneously controlled by one scan line and receive data signals substantially simultaneously may be understood as one pixel row. For example, pixels that receive a data signal based on a scan signal supplied to a first scan line S1 may be understood as a first pixel row.

According to an embodiment, at least one scan line may be connected to each of the pixels PX. Although not shown, the pixels PX may be additionally connected to an emission control line.

The pixels PX may emit light with grayscale and luminance corresponding to the data signal supplied from the data lines D1 to Dm. Each of the pixels PX may include a driving transistor and at least one switching transistor. Each of the pixels PX may include an organic light emitting element, an inorganic light emitting element, or a light emitting element composed of a combination of organic and inorganic materials.

In an embodiment, the display panel 100 may be driven in one of a first mode displaying an image at a first frequency and a second mode displaying an image at a second frequency. For example, the first mode may be a driving mode for displaying a moving image, and the second mode may be a driving mode for displaying a static image or displaying an image with low power.

In an embodiment, in the first mode, the moving image may be displayed at a driving frequency of the first frequency. For example, the first frequency may have a frequency value of 60 Hz or higher. However, this is an example, and the first frequency is not limited thereto. For example, the first frequency in the first mode may be set to a value smaller than 60 Hz (for example, 24 Hz or more) according to a driving condition or a setting.

In the second mode, an image may be displayed at a driving frequency less than or equal to the first frequency. For example, the second mode may include a power saving mode, a static image mode, an always on display (AOD) mode, and the like, and the second frequency, which is the driving frequency, may have a frequency value of 30 Hz or less. However, this is an example, and the second frequency may have a value greater than 30 Hz according to a driving condition, a setting, or a relationship with the first frequency.

The controller 200 may function as a timing controller. In an embodiment, the controller 200 may generate a scan control signal SCS and a data control signal DCS based on clock signals and control signals supplied from outside. The scan control signal SCS may be supplied to the scan driver 300, and the data control signal DCS may be supplied to the data driver 400. In addition, the controller 200 may rearrange input image data RGB supplied from the outside and supply the rearranged image data to the data driver 400.

The scan control signal SCS may include a scan start pulse and scan clock signals. The scan start pulse may control the first timing of the scan signal. The scan clock signals may be used to shift the scan start pulse.

The data control signal DCS may include a source start pulse and data clock signals. The source start pulse may control a sampling start point of image data DATA1 rearranged. The data clock signals may be used to control a sampling operation.

The controller 200 may generate the image data DATA1 in which the input image data RGB is rearranged in response to the first mode or the second mode. The input image data RGB provided from the outside may be provided serially in a repeating order of red-green-blue. The controller 200 may rearrange the input image data RGB to suit the pixel arrangement and driving method of the display panel.

An order in which pixel rows are selected in the second mode may be set differently from an order in which the pixel rows are selected in the first mode (for example, a method in which the scan signal is supplied to write data). For example, in the first mode, the data signals may be sequentially written from a first pixel row to a last pixel row during one frame. In the second mode, one frame may include a plurality of writing periods and a plurality of power saving periods. During each writing period, only some pixel rows may be selected so that the data signals may be written. Accordingly, the image data DATA1 may be arranged in a first arrangement type in the first mode, and the image data DATA1 may be arranged in a second arrangement type in the second mode. For example, the controller 200 may generate the image data DATA1 in which the input image data RGB is rearranged according to an order in which the pixel rows are selected in the writing periods of the second mode.

Hereinafter, a writing period may be understood as a period in which the data signal is supplied to the display panel 100 by the scan signal, and a power saving period may be understood as a period in which supply of the scan signal and the data signal for writing data to the display panel 100 is stopped.

The scan driver 300 may supply the scan signal to the scan lines S1 to Sn corresponding to the pixel rows based on the scan control signal SCS. For example, the scan driver 300 may sequentially supply the scan signal to the scan lines S1 to Sn. When the scan signal is sequentially supplied, the pixels PX may be selected in units of horizontal lines (or units of pixel rows).

In the first mode, the scan driver 300 may sequentially supply the scan signal to all pixel rows (the scan lines S1 to Sn) during a first period corresponding to the first frequency. The first period may correspond to the total time in which one frame of the first mode progresses.

In the second mode, the scan driver 300 may supply the scan signal to some pixel rows, respectively, during the writing periods, and may stop supplying the scan signal during the power saving periods. For example, when one frame includes a first writing period and a second writing period, the scan signal for writing data may be sequentially supplied to odd-numbered pixel rows during the first writing period, and the scan signal for writing data may be sequentially supplied to even-numbered pixel rows during the second writing period. In this way, different pixel rows may be selected in each of the writing periods to write data.

The data driver 400 may receive the data control signal DCS and the image data DATA1. The data driver 400 may supply analog data signals converted from the image data DATA1 to output channels CH1 to CHm in response to the data control signal DCS. In the embodiment of FIG. 1, the output channels CH1 to CHm may correspond to the data lines D1 to Dm on a one-to-one basis. Hereinafter, in describing FIGS. 1, 2, 3, 4, 5, 6, 7, 8, and 9, the output channels CH1 to CHm may be understood to be the same as the data lines D1 to Dm.

The data signal supplied to the data lines D1 to Dm may be supplied to the pixels PX selected by the scan signal. To this end, the data driver 400 may supply the data signal to the data lines D1 to Dm so as to be synchronized with the scan signal.

In an embodiment, the data driver 400 may supply the data signals to the data lines D1 to Dm during the writing periods. During the power saving periods, the data driver 400 may stop outputting the data signals.

In an embodiment, the gamma generator 500 may provide a first gamma set GM1 corresponding to a first color, a second gamma set GM2 corresponding to a second color, and a third gamma set GM3 corresponding to a third color to the data driver 400. For example, the first color, the second color, and the third color may be red, green, and blue, respectively.

Grayscale values of each data included in the image data DATA1 may be expressed as 0 to 255 grayscales. The first gamma set GM1 may include information on gamma voltages (or grayscale voltages) corresponding to grayscale values of red data. The second gamma set GM2 may include information on gamma voltages (or grayscale voltages) corresponding to grayscale values of green data. The third gamma set GM3 may include information on gamma voltages (or grayscale voltages) corresponding to grayscale values of blue data.

The data driver 400 may convert the grayscale values included in the image data DATA1 into the data signals, which are analog gamma voltages, based on the first, second, and third gamma sets GM1, GM2, and GM3.

Since gamma curves are different according to red, green, and blue, voltages of the output data signals may be different even if the grayscales are the same. For example, when the red data, the green data, and the blue data are all 100 grayscales, voltages of the data signals output corresponding thereto may be different from each other.

Therefore, since the first arrangement type and the second arrangement type of the image data DATA1 are different, under the same input grayscale condition, a change in voltage of the data signals output to a first output channel CH1 in one frame of the first mode and a change in voltage of the data signals output to the first output channel CH1 in one frame of the second mode may be different.

In an embodiment, the controller 200 may not generate signals for driving the data driver 400 such as the data control signal DCS during the power saving periods.

In an embodiment, at least some functions of the controller 200, the data driver 400, and the gamma generator 500 may be integrated into one driving circuit. For example, the driving circuit may be provided in the form of an integrated circuit that performs functions of the controller 200, the data driver 400, and the gamma generator 500.

Figure 2:
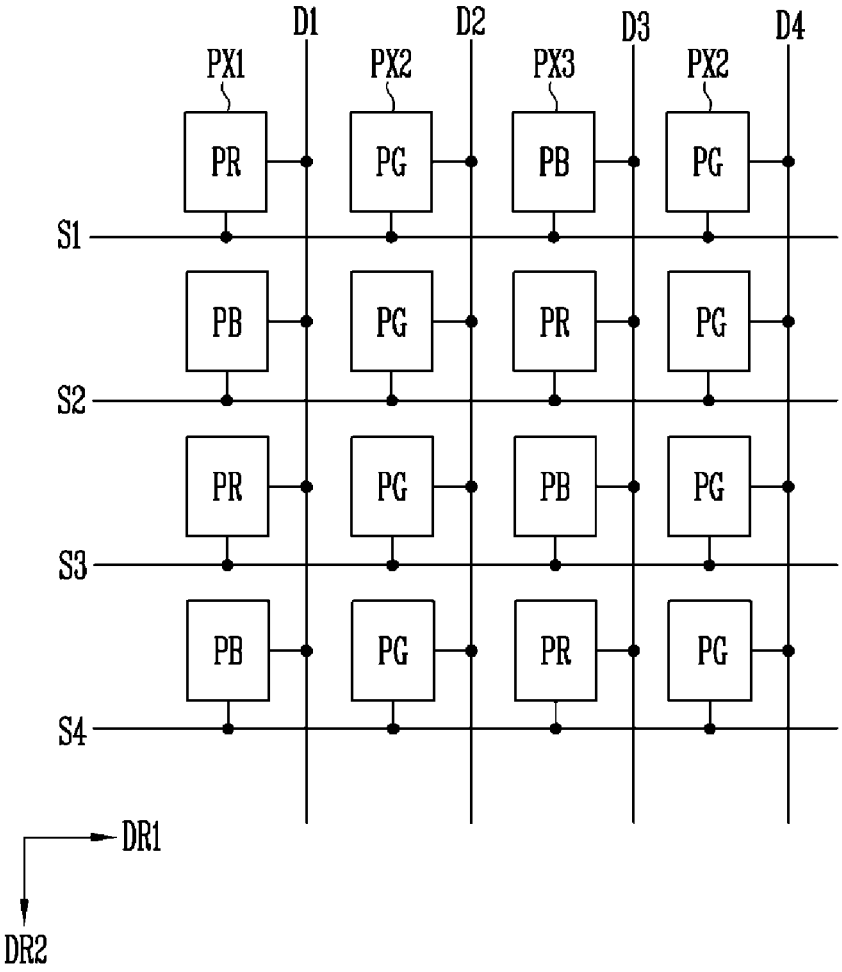
FIG. 2 is a diagram illustrating an example of a display panel included in the display device of FIG. 1.

FIG. 2 is a diagram illustrating an example of a display panel included in the display device of FIG. 1.

Referring to FIG. 2, the display panel 100 may include a plurality of pixels PX1, PX2, and PX3, and scan lines S1 to S4 and data lines D1 to D4 connected to the pixels PX1, PX2, and PX3.

FIG. 2 shows a part of the display panel 100. In FIG. 2, S1 and D1 are not limited to first signal lines of all scan lines and data lines, respectively. For example, first, second, third, and fourth scan lines S1, S2, S3, and S4 may be understood as scan lines corresponding to successive pixel rows, and first, second, third, and fourth data lines D1, D2, D3, and D4 may be understood as data lines corresponding to successive pixel columns.

The pixels PX may include a first pixel PX1, a second pixel PX2, and a third pixel PX3. The first pixel PX1, the second pixel PX2, and the third pixel PX3 may emit light of a first color, a second color, and a third color, respectively. In an embodiment, the first color, the second color, and the third color may be different colors, respectively, and may be one of red, green, and blue.

For example, in a first pixel row (and the odd-numbered pixel rows) controlled by the first scan line S1, the pixels PX1, PX2, and PX3 may be arranged in the order of a red pixel PR, a green pixel PG, a blue pixel PB, and a green pixel PG in a first direction DR1. In a second pixel row (and the even-numbered pixel rows) controlled by a second scan line S2, the pixels PX1, PX2, and PX3 may be arranged in the order of the blue pixel PB, the green pixel PG, the red pixel PR, and the green pixel PG in the first direction DR1.

The pixel arrangement of the first pixel row and the pixel arrangement of the second pixel row may be alternately repeated in a second direction DR2. However, this is an example, and the pixel arrangement is not limited thereto.

Figure 3:
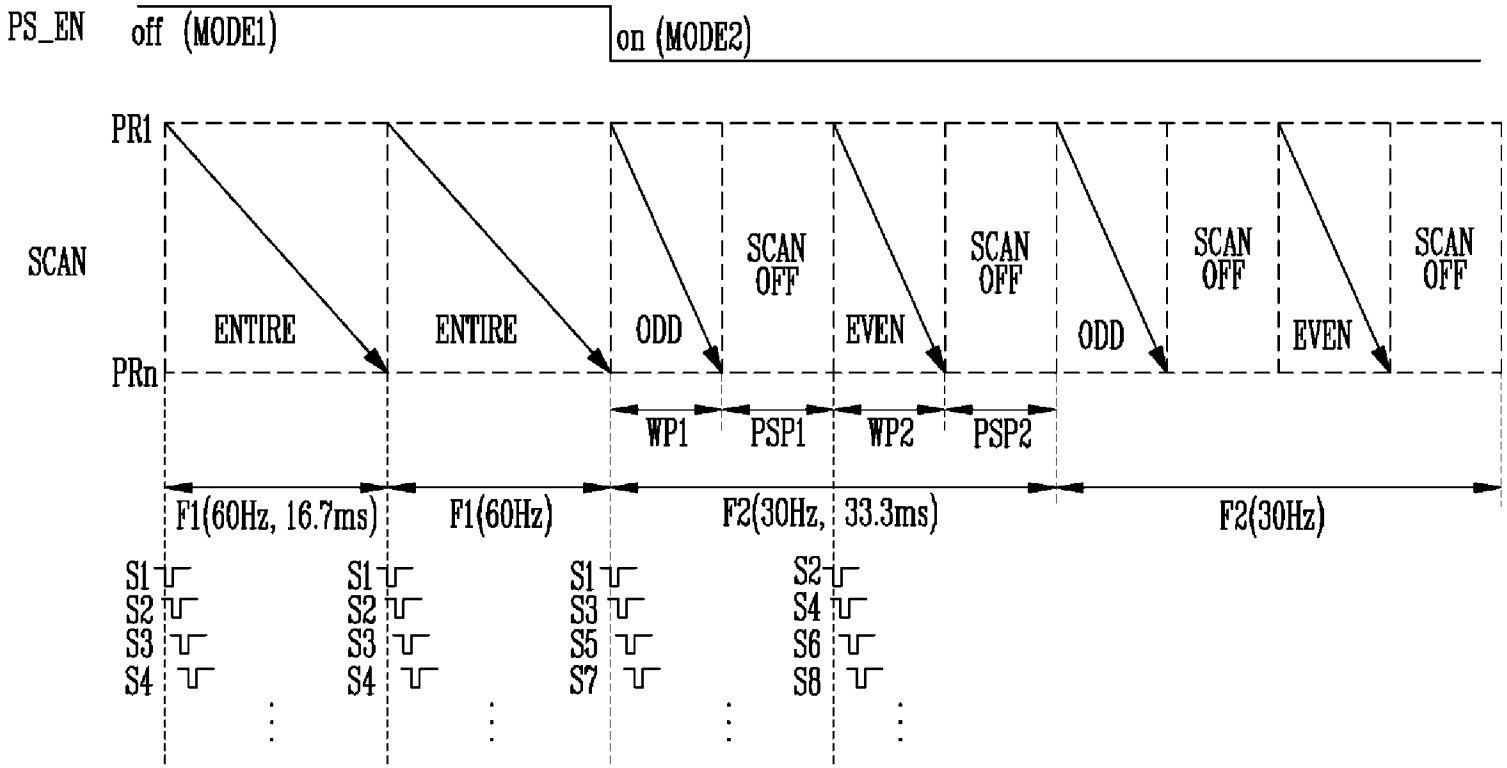
FIG. 3 is a diagram illustrating an example of an operation of a scan driver included in the display device of FIG. 1.
Figure 4:
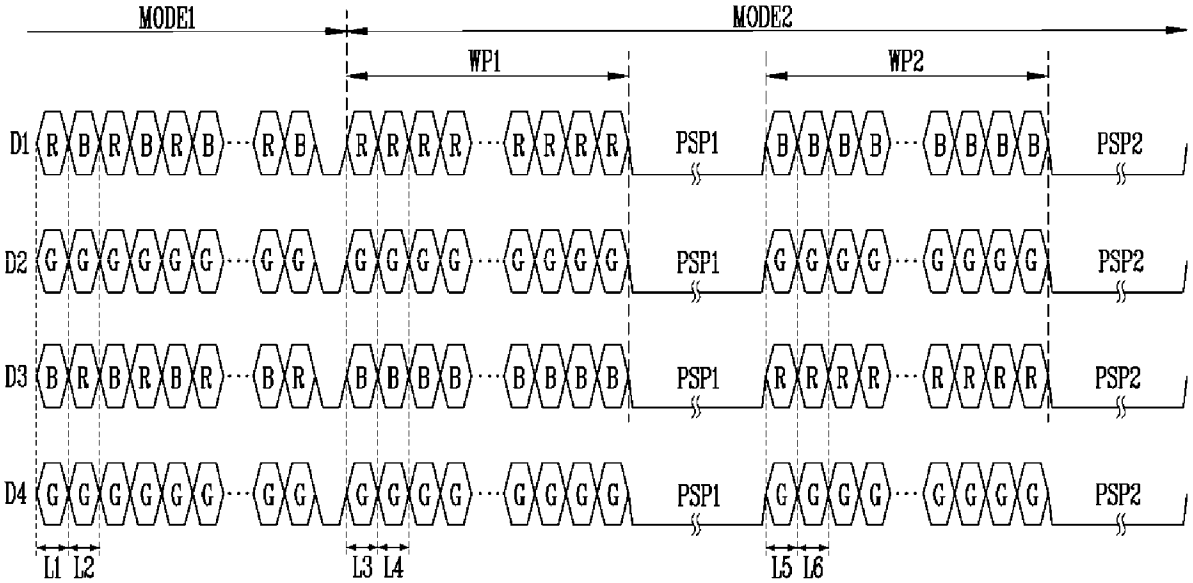
FIG. 4 is a diagram for explaining an example of data signals supplied to data lines in response to the operation of the scan driver of FIG. 3.

FIG. 3 is a diagram illustrating an example of an operation of a scan driver included in the display device of FIG. 1. FIG. 4 is a diagram for explaining an example of data signals supplied to data lines in response to the operation of the scan driver of FIG. 3.

Referring to FIGS. 1, 2, 3, and 4, a driving mode and a driving frequency of the display device 1000 may be changed, and a scan driving method may be changed corresponding to the driving mode.

In an embodiment, a first mode MODE1 or a second mode MODE2 may be activated based on activation of a partial scan activation signal PS_EN. The partial scan activation signal PS_EN may be activated based on whether a static image is included. For example, when the static image is displayed, the partial scan activation signal PS_EN may be activated, and the display device 1000 may perform partial scan driving corresponding to the second mode MODE2. The partial scan driving may be activated for low frequency driving to reduce power consumption. The partial scan driving may scan all pixel rows by periodically supplying the scan signal for writing data to some different pixel rows within one frame. In the low frequency driving to reduce power consumption, the partial scan driving may be a technique for improving a side effect such as image flicker due to leakage of driving current within a pixel.

The controller 200 may control the scan driver 300 and the data driver 400 to drive in the second mode MODE2. In addition, the controller 200 may rearrange the input image data RGB into the image data DATA1 of the second arrangement type according to the second mode MODE2.

In an embodiment, an image frame (first frames) in the first mode MODE1 may be driven at a first frequency F1 (for example, 60 Hz). Accordingly, a first frame may be driven during a time of about 16.7 ms.

The image data DATA1 of the first arrangement type may include all image data from the first pixel in a first pixel row PR1 to the last pixel in an n-th pixel row PRn (that is, the last pixel row). The image data DATA1 of the first arrangement type may correspond to the pixel arrangement of FIG. 2. For example, the image data DATA1 may have an arrangement of red-green-blue-green (for example, RGBG) corresponding to the first pixel row PR1, and may have an arrangement of blue-green-red-green (for example, BGRG) corresponding to a second pixel row PR2.

The scan driver 300 may supply a scan signal SCAN to pixel rows PR1 to PRn (that is, the scan lines S1 to Sn) in a general driving method. For example, one frame may be driven at 60 Hz, and the scan signal SCAN may be sequentially supplied to the first to n-th pixel rows PR1 to PRn. The data driver 400 may output data signals corresponding to each of the first to n-th pixel rows PR1 to PRn in units of pixel rows in synchronization with the scan signal.

In an embodiment, an image frame (second frames) in the second mode MODE2 may be driven at a second frequency F2 (for example, 30 Hz). A second frame may be driven during a time of about 33.3 ms.

The frame in the second mode MODE2 may include first and second writing periods WP1 and WP2 and first and second power saving periods PSP1 and PSP2. The writing periods WP1 and WP2 and the power saving periods PSP1 and PSP2 may be set to proceed alternately.

The image data DATA1 of the second arrangement type may be rearranged to correspond to each of the writing periods WP1 and WP2.

In an embodiment, the image data DATA1 corresponding to a first writing period WP1 may be image data of the odd-numbered pixel rows, and the image data DATA1 corresponding to a second writing period WP2 may be image data of the even-numbered pixel rows.

In the first writing period WP1, the scan signal SCAN for writing data to the odd-numbered pixel rows may be sequentially supplied. For example, the scan signal SCAN may be sequentially supplied to the first scan line S1, a third scan line S3, a fifth scan line S5, and a seventh scan line S7. The timing at which the scan signal is supplied to the first scan line S1, the third scan line S3, the fifth scan line S5, and the seventh scan line S7 in the first writing period WP1 may be substantially equal to the timing at which the scan signal is supplied to the first scan line S1, the second scan line S2, the third scan line S3, and the fourth scan line S4 in the first mode. Therefore, in this case, compared to when driving at 60 Hz in the first mode MODE1, since the pixel rows to which the scan signal SCAN is supplied are reduced by half, the length of the first writing period WP1 may correspond to about half of a time when the scan signal SCAN is supplied to all pixel rows when driving at 60 Hz.

In the second writing period WP2, the scan signal SCAN for writing data may be sequentially supplied to the even-numbered pixel rows. The length of the first writing period WP1 may correspond to about half of the time when the scan signal SCAN is supplied to all pixel rows when driving at 60 Hz.

The time obtained by adding the first writing period WP1 and the second writing period WP2 may be substantially the same as the scan time when driving at 60 Hz.

In this way, the first writing period WP1 for writing the data signals to the odd-numbered pixel rows and the second writing period WP2 for writing the data signals to the even-numbered pixel rows may be repeated at a frequency of 30 Hz, respectively. Accordingly, it can be understood that the second mode MODE2 is substantially driven at 30 Hz.

An image may be displayed in the first power saving period PSP1 and the second power saving period PSP2. In the first power saving period PSP1 and the second power saving period PSP2, supply of the scan signal SCAN and supply of the data signals may be stopped. In addition, some functions of the controller 200 for driving the scan driver 300 and the data driver 400 may also be deactivated.

FIG. 4 shows the image data corresponding to the data signals output to the first data line D1 (for example, a first channel CH1), the image data corresponding to the data signals output to the second data line D2 (a second channel), the image data corresponding to the data signals output to the third data line D3 (a third channel), and the image data corresponding to the data signals output to the fourth data line D4 (a fourth channel) in each of the first mode MODE1 and the second mode MODE2. In an embodiment, the controller 200 may generate (or arrange) the image data DATA1 according to the order in which the pixel rows PR1 to PRn are selected in the writing periods WP1 and WP2 of the second mode MODE2.

The data signal corresponding to the red pixel PR may be generated by applying the first gamma set GM1 to red data R. The second gamma set GM2 may be applied to green data G, and the third gamma set GM3 may be applied to blue data B.

Meanwhile, an arrangement of the image data in a vertical direction in FIG. 4 may be understood as an arrangement of the image data corresponding to each of the pixel rows. As described with reference to FIG. 3, for the partial scan driving in the second mode MODE2, the image data DATA1 may be arranged differently from the first mode MODE1, and the data signals may be output differently. In the first mode MODE1, an arrangement of RGBG (corresponding to a first line L1 (for example, the first pixel row)) and an arrangement of BGRG (corresponding to a second line L2 (for example, the second pixel row)) may be repeated alternately for each pixel row. In the first writing period WP1 of the second mode MODE2, only an arrangement of RGBG (corresponding to a third line L3 (for example, the first pixel row) and a fourth line L4 (for example, the third pixel row)) may be repeated. In the second writing period WP2 of the second mode MODE2, only an arrangement of BGRG (corresponding to a fifth line L5 (for example, the second pixel row) and a sixth line L6 (for example, the fourth pixel row)) may be repeated. The supply of the image data DATA1 and/or the data signals may be stopped during the first and second power saving periods PSP1 and PSP2.

In an embodiment, in the pixel arrangement structure of FIG. 2, only the data signals corresponding to the green data G may be output to the second data line D2 and the fourth data line D4 (for example, even-numbered data lines). Accordingly, the second gamma set GM2 may be applied to the green data G corresponding to the second data line D2 and the fourth data line D4.

In the first mode MODE1, the red data R and the blue data B may be sequentially latched alternately in correspondence with the first data line D1, and the blue data B and the red data R may be sequentially latched alternately in correspondence with the third data line D3, contrary to the first data line D1. Accordingly, the first gamma set GM1 and the third gamma set GM3 may be alternately applied to data latched in correspondence with the first data line D1, and the third gamma set GM3 and the first gamma set GM1 may be alternately applied to data latched in correspondence with the third data line D3.

In an embodiment, the controller 200 may provide configuration data including mode information (the first mode or the second mode) and gamma application information to the data driver 400 during a vertical blank period of a frame. The data driver 400 may select a gamma set corresponding to the color of the image data DATA1 based on the gamma application information included in the configuration data, and may convert a digital grayscale value corresponding to a position of a corresponding pixel into an analog data signal using the selected gamma set. That is, the gamma set corresponding to the color (arrangement type) of the image data DATA1 may be appropriately selected according to the gamma application information.

In an embodiment, since only the odd-numbered pixel rows are selected in the first writing period WP1, the red data R may be continuously latched corresponding to the first data line D1 in the first writing period WP1. In the first writing period WP1, the first gamma set GM1 may be applied to the image data corresponding to the first data line D1. In addition, in the first writing period WP1, the blue data B may be continuously latched corresponding to the third data line D3. In the first writing period WP1, the third gamma set GM3 may be applied to the image data corresponding to the third data line D3.

Since only the even-numbered pixel rows are selected in the second writing period WP2, in the second writing period WP2, the blue data B may be continuously latched corresponding to the first data line D1. In the second writing period WP2, the third gamma set GM3 may be applied to the image data corresponding to the first data line D1. In addition, in the second writing period WP2, the red data R may be continuously latched corresponding to the third data line D3. In the second writing period WP2, the first gamma set GM1 may be applied to the image data corresponding to the third data line D3.

As described above, an arrangement of the red data R, which is an arrangement of the image data DATA1 corresponding to the first writing period WP1 of the first data line D1, may be different from an arrangement of the blue data B, which is the arrangement of the image data DATA1 corresponding to the second writing period WP2 of the first data line D1. Similarly, an arrangement of the blue data B, which is the arrangement of the image data DATA1 corresponding to the first writing period WP1 of the third data line D3, may be different from an arrangement of the red data R, which is the arrangement of the image data DATA1 corresponding to the second writing period WP2 of the third data line D3.

Accordingly, in an embodiment, under the same input grayscale condition, a change in voltage of the data signals output to the first data line D1 in the first writing period WP1 may be different from a change in voltage of the data signals output to the first data line D1 in the second writing period WP2. For example, when both the red data R and the blue data B have a value of 200 grayscales, a data signal of a first voltage level may be output to the first data line D1 in the first writing period WP1, and a data signal of a second voltage level different from the first voltage level may be output to the first data line D1 in the second writing period WP2.

In addition, output of the data signals (and the image data corresponding thereto) to odd-numbered data lines including the first data line D1 and the third data line D3 in the second mode MODE2 may be different from output of the data signals (and the image data corresponding thereto) to the odd-numbered data lines in the first mode MODE1. In an embodiment, under the same input grayscale condition, a change in voltage of the data signals output to the first data line D1 during the first frame of the first mode MODE1 and a change in voltage of the data signals output to the first data line D1 during the second frame of the second mode MODE2 may be different. For example, in the first mode MODE1, a red data signal and a blue data signal may be alternately output to the first data line D1 during one frame. In the second mode MODE2, the red data signal may be output to the first data line D1 in the first writing period WP1, and the blue data signal may be output to the first data line D1 in the second writing period WP2. In the first power saving period PSP1 and the second power saving period PSP2, the output of the data signal may be stopped or a predetermined DC voltage may be output to the data lines D1, D2, D3, and D4.

As described above, in the display device 1000 and the driving method thereof according to the embodiments of the present disclosure, the image data DATA1 may be arranged in different arrangement types in the first mode MODE1 and the second mode MODE2 in response to the partial scan driving in the second mode MODE2, and different gamma sets GM1, GM2, and GM3 may be applied to outputs of the data signals corresponding to the odd-numbered data lines D1 and D3 in the first mode MODE1 and the second mode MODE2. Accordingly, in the partial scan driving in the pixel arrangement of FIG. 2, incorrect reflection (mismatch) of blue gamma (red gamma) on the red data R (blue data B) can be prevented, and the data signals can be optimized and output in each of the first mode MODE1 and the second mode MODE2. Accordingly, both power consumption and image quality can be improved during the partial scan driving.

Figure 5:
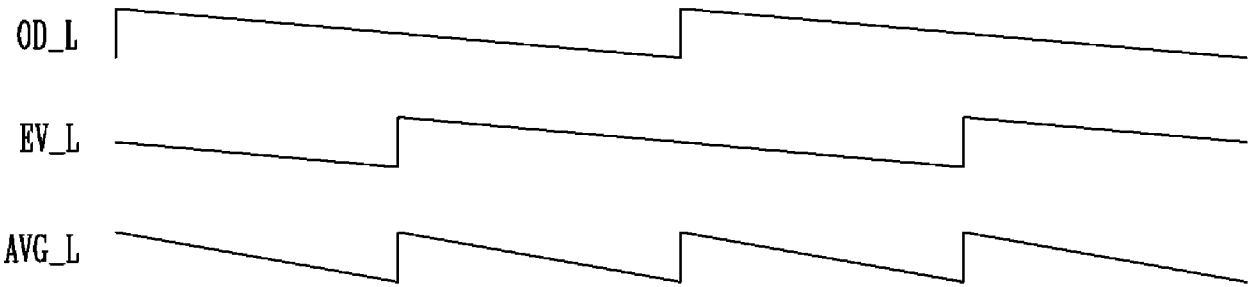
FIG. 5 is a diagram schematically illustrating a change in luminance when driving at 30 Hz in FIG. 3.

FIG. 5 is a diagram schematically illustrating a change in luminance when driving at 30 Hz in FIG. 3.

Referring to FIGS. 4 and 5, a first luminance OD_L that is the luminance of the odd-numbered pixel rows and a second luminance EV_L that is the luminance of the even-numbered pixel rows may be detected differently by the partial scan driving.

The pixel may include a light emitting element that emits light by a driving current. The driving current may leak due to inherent characteristics of transistors included in the pixel. Accordingly, when the light emitting element emits light after data is written, the luminance may decrease over time due to leakage of the driving current.

As shown in FIG. 4, the first writing period WP1 for the odd-numbered pixel rows and the second writing period WP2 for the even-numbered pixel rows may be alternately repeated with each other in a cycle of 30 Hz.

Accordingly, the first luminance OD_L and the second luminance EV_L may be refreshed every about 33.4 ms, respectively. Accordingly, an average luminance AVG_L, which is an average of the first luminance OD_L and the second luminance EV_L, may exhibit a change in luminance similar to that of driving at 60 Hz.

In other words, the partial scan driving according to the embodiments of the present disclosure can improve the image flicker, which is a side effect of the low frequency driving.

Figure 6:
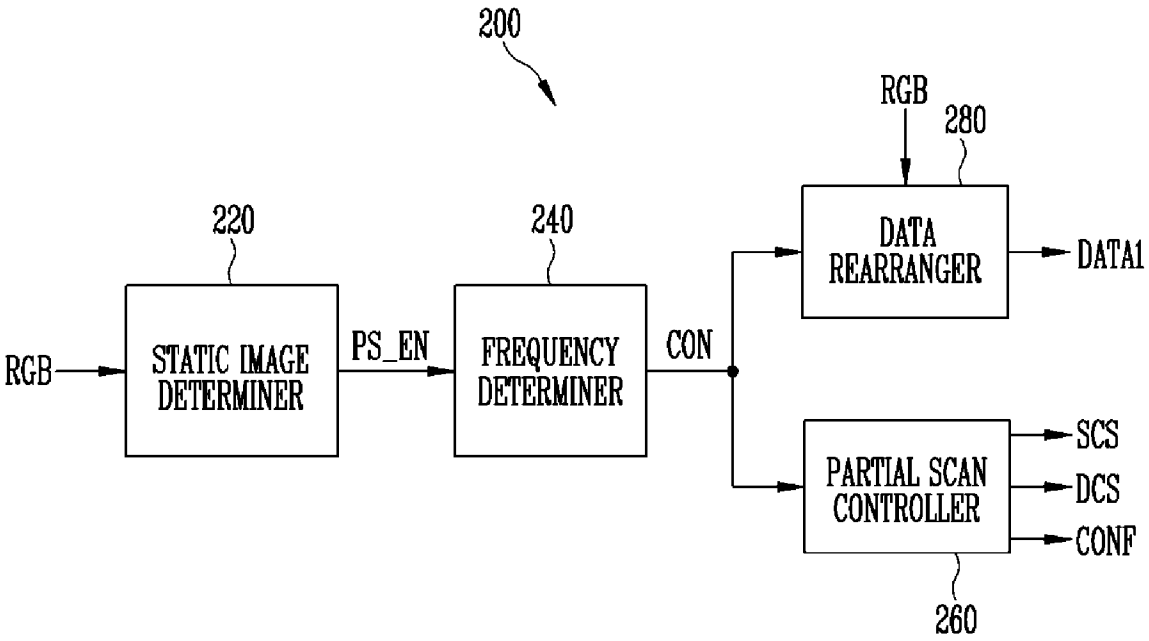
FIG. 6 is a block diagram illustrating an example of a controller included in the display device of FIG. 1.

FIG. 6 is a block diagram illustrating an example of a controller included in the display device of FIG. 1.

Referring to FIGS. 3, 4, and 6, the controller 200 may include a static image determiner 220, a frequency determiner 240, a partial scan controller 260, and a data rearranger 280. That is, the static image determiner 220 may be electrically connected to the frequency determiner 240, and the frequency determiner 240 may be electrically connected to both data rearranger 280 and the partial scan controller 260.

The controller 200 may generate the image data DATA1 based on the second mode MODE2 (i.e., PS_EN). Furthermore, the controller 200 may control the scan driver 300 and the data driver 400 based on the second mode MODE2 (i.e., PS_EN).

The static image determiner 220 may detect a static image (or a low-power image) by comparing the input image data RGB of successive frames. For example, the static image determiner 220 may determine whether an image is the static image or not by comparing a previous frame and the current frame. The static image determiner 220 may determine the static image based on a difference between a checksum of the input image data RGB of an (n−1)th frame and a checksum of the input image data RGB of an n-th frame, where n may be an integer greater than 1. For example, when the difference between the checksums is greater than a predetermined reference value, the static image determiner 220 may determine that the n-th frame includes a moving image (or the n-th frame is not the static image). When the checksums are equal (or the difference between the checksums is less than or equal to the predetermined reference value), the static image determiner 220 may determine that the n-th frame is the static image, and may output the partial scan activation signal PS_EN.

However, this is an example, and a method of determining the static image is not limited thereto. Whether or not the corresponding frame is the static image may be determined through various known algorithms and/or hardware configurations.

The frequency determiner 240 may activate the second mode MODE2 based on the detected static image and determine the second frequency F2. In an embodiment, the frequency determiner 240 may generate a control signal CON for controlling the partial scan controller 260 and the data rearranger 280 in response to the partial scan activation signal PS_EN. The control signal CON may include information on the second frequency F2. The second frequency F2 may be related to the number of writing periods, information on pixel rows selected for each of the writing periods, and an arrangement (the gamma application information) of the image data DATA1 corresponding to each of the writing periods. In an embodiment, the second frequency F2 may be a preset value. Furthermore, the second frequency F2 may vary depending on a structure of the display panel 100 and the like.

The partial scan controller 260 may generate the scan control signal SCS and the data control signal DCS for controlling driving of the scan driver 300 and the data driver 400 in the writing periods WP1 and WP2 and the power saving periods PSP1 and PSP2, respectively, based on the second frequency F2.

Furthermore, the partial scan controller 260 may generate configuration data CONF including the gamma application information corresponding to the image data DATA1 input to the data driver 400 according to a mode based on the second frequency F2. For example, as shown in FIG. 4, in response to the configuration data CONF, the data driver 400 may use the gamma sets GM1, GM2, and GM3 to suit different arrangement types of the image data DATA1 of the first mode MODE1 or the second mode MODE2. Accordingly, in the partial scan driving in the second mode MODE2, an error in which the blue gamma is applied to the red data R and an error in which the red gamma is applied to the blue data B can be prevented.

The data rearranger 280 may rearrange the input image data RGB based on the second frequency F2 in the second mode MODE2. The image data DATA obtained by rearranging the input image data RGB may be provided to the data driver 400. In an embodiment, the data rearranger 280 may output the image data DATA1 as described with reference to FIG. 4.

Figure 7:
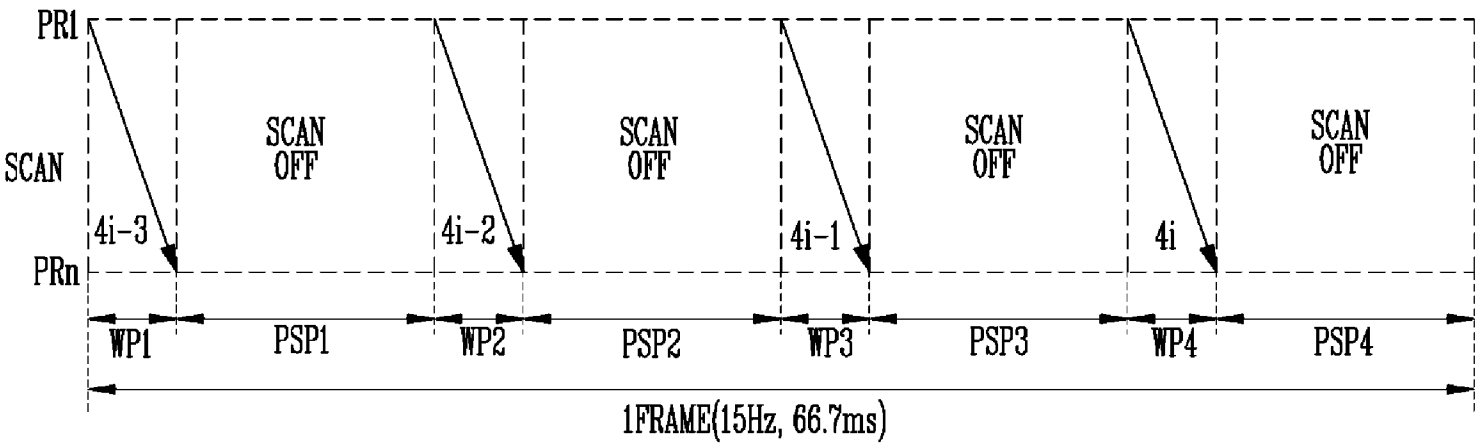
FIG. 7 is a diagram illustrating an example of an operation in a second mode of the scan driver included in the display device of FIG. 1.

FIG. 7 is a diagram illustrating an example of an operation in a second mode of the scan driver included in the display device of FIG. 1.

In FIG. 7, the same reference numerals may be used for the components described with reference to FIGS. 3 and 4, and duplicate descriptions of these components will be omitted. Meanwhile, in FIG. 7, a description will be made on the premise that the driving frequency (the first frequency) in the first mode MODE1 is set to 60 Hz.

Referring to FIGS. 1, 3, 4, and 7, in the second mode MODE2, the partial scan driving in a frame 1FRAME may be performed at the driving frequency (the second frequency) of 15 Hz. The frame 1FRAME may be driven during a time of about 66.7 ms.

Since the second frequency corresponds to ¼ of the first frequency, the frame 1FRAME may include first to fourth writing periods WP1, WP2, WP3, and WP4 and first to fourth power saving periods PSP1, PSP2, PSP3, and PSP4. In an embodiment, the length of each of the first to fourth writing periods WP1, WP2, WP3, and WP4 may correspond to about ¼ of a time when the scan signal SCAN is supplied to all pixel rows when driving at 60 Hz. Correspondingly, lengths of the first to fourth power saving periods PSP1, PSP2, PSP3, and PSP4 may increase.

As described above, as an image driving frequency decreases, the number of times the writing period and the power saving period are repeated within one frame may increase. Furthermore, as the image driving frequency decreases, the length of each of the writing periods WP1 to WP4 may decrease, and the length of each of the power saving periods PSP1, PSP2, PSP3, and PSP4 may increase. Therefore, the effect of reducing power consumption in the low frequency driving can be maximized.

Meanwhile, since the pixel rows selected in the first writing period WP1 and the third writing period WP3 (that is, (4i−3)th pixel rows and (4i−1)th pixel rows, where i may be an integer greater than 0) are the odd-numbered pixel rows, driving of the first writing period WP1 and the third writing period WP3 may be substantially equal to the driving of the first writing period WP1 of FIGS. 3 and 4. Since the pixel rows selected in the second writing period WP2 and the fourth writing period WP4 (that is, (4i−2)th pixel rows and 4i-th pixel rows) are the even-numbered pixel rows, driving of the second writing period WP2 and the fourth writing period WP4 may be substantially equal to the driving of the second writing period WP2 of FIGS. 3 and 4. Accordingly, descriptions overlapping with those described with reference to FIGS. 3 and 4 will be omitted.

Figure 8:
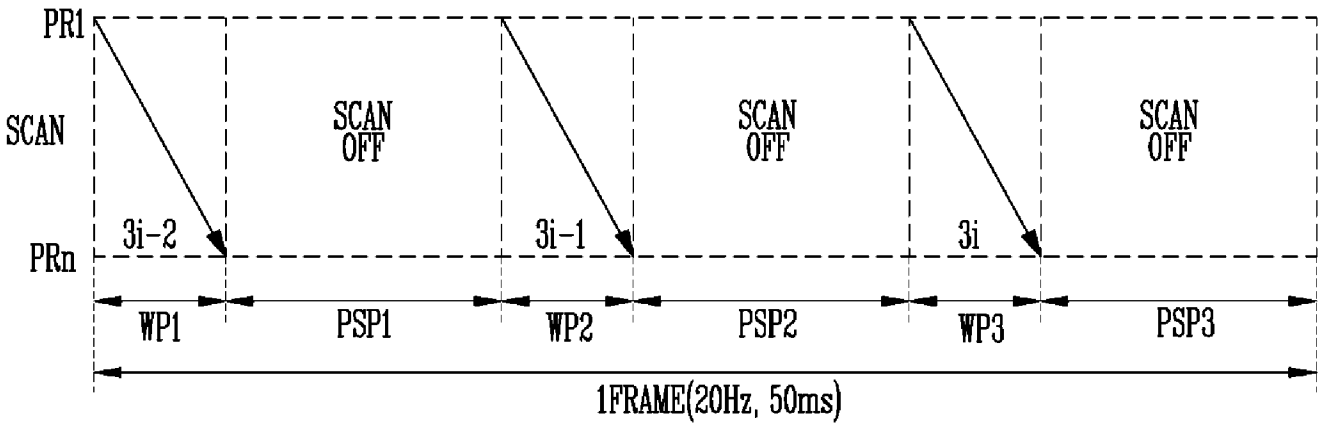
FIG. 8 is a diagram illustrating an example of an operation in a second mode of the scan driver included in the display device of FIG. 1.
Figure 9:
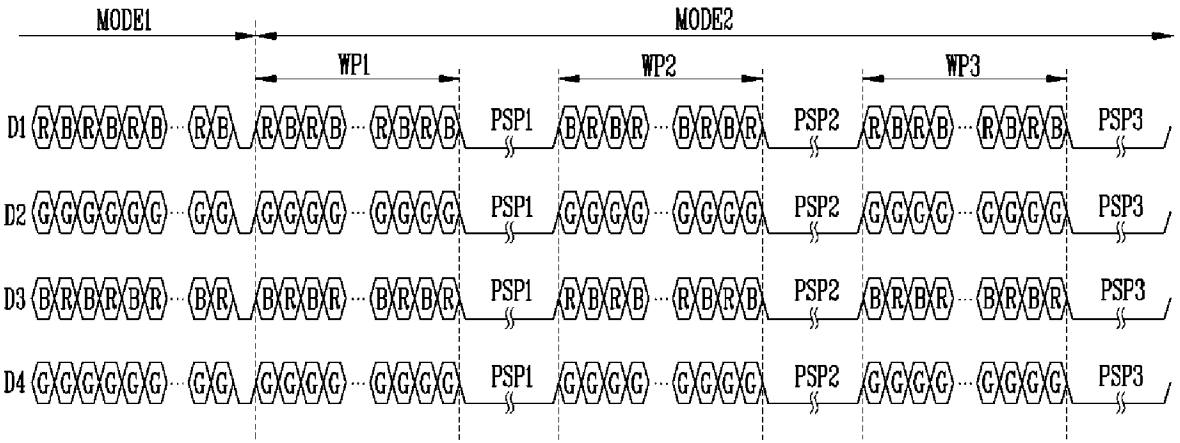
FIG. 9 is a diagram for explaining an example of data signals supplied to data lines in response to the operation of the scan driver in FIG. 8.

FIG. 8 is a diagram illustrating an example of an operation in a second mode of the scan driver included in the display device of FIG. 1. FIG. 9 is a diagram for explaining an example of data signals supplied to data lines in response to the operation of the scan driver in FIG. 8.

In FIG. 8, the same reference numerals may be used for the components described with reference to FIGS. 3 and 4, and duplicate descriptions of these components will be omitted. Meanwhile, in FIG. 8, a description will be made on the premise that the driving frequency (the first frequency) in the first mode MODE1 is set to 60 Hz.

Referring to FIGS. 1, 3, 4, 8, and 9, in the second mode MODE2, the partial scan driving in the frame 1FRAME may be performed at the driving frequency (the second frequency) of 20 Hz. The frame 1FRAME may be driven during a time of about 50 ms.

Since the second frequency corresponds to ¼ of the first frequency, the frame 1FRAME may include first to third writing periods WP1, WP2, and WP3 and first to third power saving periods PSP1, PSP2, and PSP3. In an embodiment, the length of each of the first to third writing periods WP1, WP2, and WP3 may correspond to about ⅓ of a time when the scan signal SCAN is supplied to all pixel rows when driving at 60 Hz. Correspondingly, the lengths of the first to fourth power saving periods PSP1 to PSP4 may be increased.

Since (3i−2)th pixel rows are selected in the first writing period WP1, the odd-numbered pixel rows and the even-numbered pixel rows may be alternately selected. Since (3i−1)th pixel rows are selected in the second writing period WP2, the even-numbered pixel rows and odd-numbered pixel rows may be alternately selected. Since (3i)th pixel rows are selected in the third writing period WP3, the odd-numbered pixel rows and the even-numbered pixel rows may be alternately selected.

In an embodiment, the controller 200 may provide the configuration data including the mode information (the first mode or the second mode) and the gamma application information to the data driver 400 during the vertical blank period of the frame. The data driver 400 may select the gamma set corresponding to the color of the image data DATA1 based on the configuration data, and may convert the digital grayscale value corresponding to the position of the corresponding pixel into the analog data signal using the selected gamma set.

In an embodiment, since the odd-numbered pixel rows and the even-numbered pixel rows are alternately selected in the first writing period WP1, in the first writing period WP1, the red data R and the blue data B may be latched alternately in correspondence with the first data line D1. In the first writing period WP1, the first gamma set GM1 and the third gamma set GM3 may be alternately applied to the image data in correspondence with the first data line D1. In addition, in the first writing period WP1, the blue data B and the red data R may be latched alternately in correspondence with the third data line D3. In the first writing period WP1, the third gamma set GM3 and the first gamma set GM1 may be alternately applied to the image data in correspondence with the third data line D3.

In the second writing period WP2, since the even-numbered pixel rows and the odd-numbered pixel rows are alternately selected, contrary to the first writing period WP1, in the second writing period WP2, the blue data B and the red data R may be latched alternately in correspondence with the first data line D1. In the second writing period WP2, the third gamma set GM3 and the first gamma set GM1 may be alternately applied to the image data in correspondence with the first data line D1. In addition, in the second writing period WP2, the red data R and the blue data B may be alternately latched in correspondence with the third data line D3. In the second writing period WP2, the first gamma set GM1 and the third gamma set GM3 may be alternately applied to the image data in correspondence with the third data line D3.

In the third writing period WP3, the data driver 400 may be driven substantially equal to the first writing period WP1.

As described above, a sequential arrangement (that is, RBRB) of the red data R and the blue data B corresponding to the first writing period WP1 of the first data line D1 may be different from a sequential arrangement (that is, BRBR) of the blue data B and the red data R corresponding to the second writing period WP2 of the first data line D1. In addition, a sequential arrangement (that is, RBRB) of the red data R and the blue data B corresponding to the third writing period WP3 of the first data line D1 may be different from a sequential arrangement (that is, BRBR) of the blue data B and the red data R corresponding to the second writing period WP2 of the first data line D1.

Accordingly, in an embodiment, under the same input grayscale condition, a change in voltage of the data signals output to the first data line D1 in the first writing period WP1 may be different from a change in voltage of the data signals output to the first data line D1 in the second writing period WP2 Similarly, under the same input grayscale condition, a change in voltage of the data signals output to each of the odd-numbered data lines D1 and D3 in the first writing period WP1 may be different from a change in voltage of the data signals output to each of the odd-numbered data lines D1 and D3 in the second writing period WP2.

In addition, under the same input grayscale condition, the output of the data signals (and the image data corresponding thereto) to the odd-numbered data lines including the first data line D1 and the third data line D3 during the frame 1FRAME (for example, the second frame) in the second mode MODE2 may be different from the output of the data signals (and the image data corresponding thereto) to the odd-numbered data lines during the first frame in the first mode MODE1.

Figure 10:
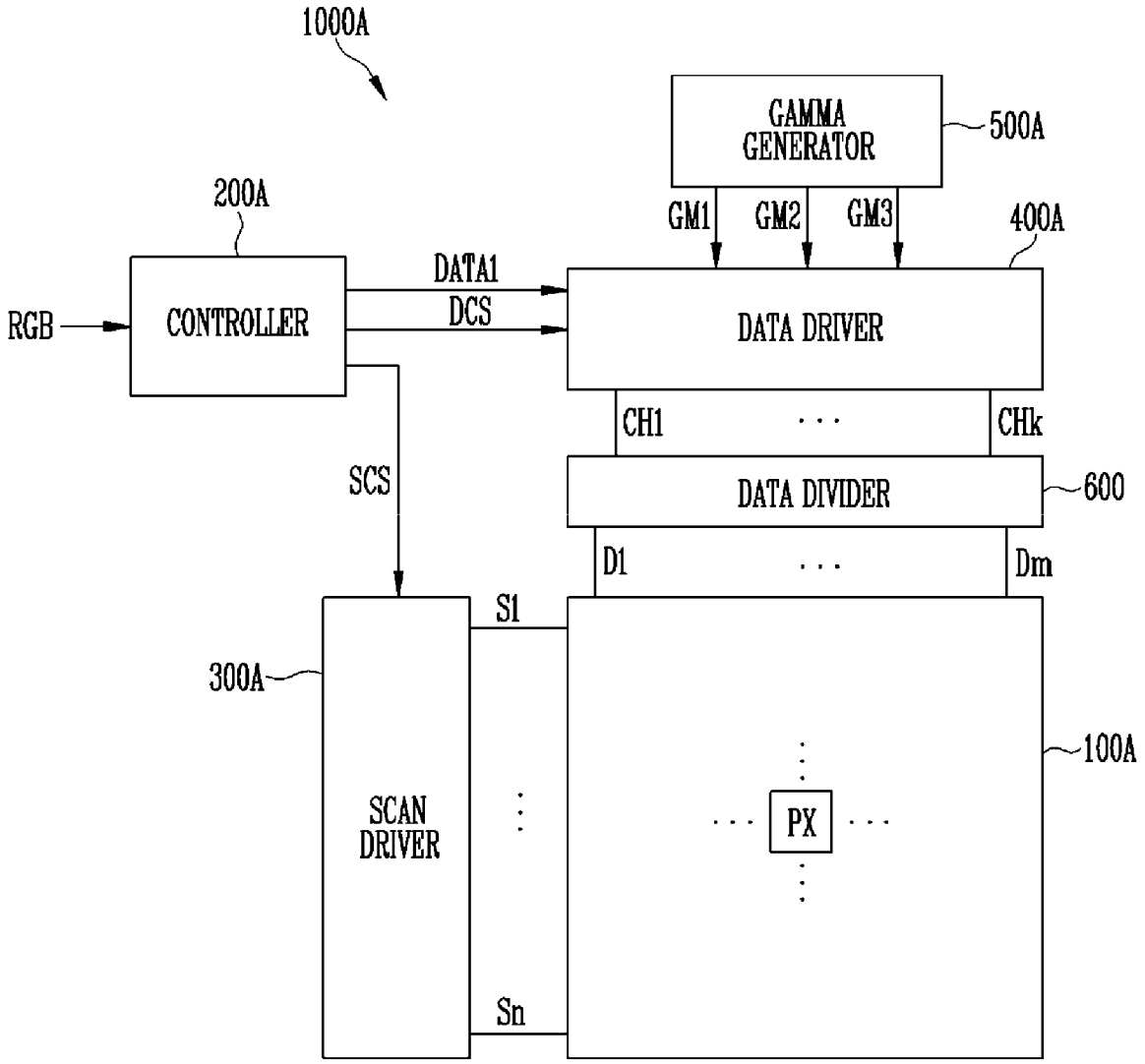
FIG. 10 is a block diagram illustrating a display device according to embodiments of the present disclosure.

FIG. 10 is a block diagram illustrating a display device according to embodiments of the present disclosure.

In FIG. 10, the same reference numerals may be used for the components described with reference to FIG. 1, and duplicate descriptions of these components will be omitted.

Referring to FIG. 10, a display device 1000A may include a display panel 100A, a controller 200A, a scan driver 300A, a data driver 400A, and a gamma generator 500A.

In an embodiment, the display device 1000A may further include a data divider 600. The data driver 400A may output a data signal to first to k-th output channels CH1 to CHk, where k may be an integer greater than 1. The data divider 600 may connect the output channels CH1 to CHk and data lines D1 to Dm connected to pixel columns of the display panel 100A to 1:j, wherein j may be an integer greater than 1. The number of data lines D1 to Dm may be greater than the number of output channels CH1 to CHk.

For example, the data divider 600 may include a plurality of demultiplexers having an input/output ratio of 1:j. The data lines D1 to Dm may be driven in a time-division manner by the data divider 600.

Figure 11:
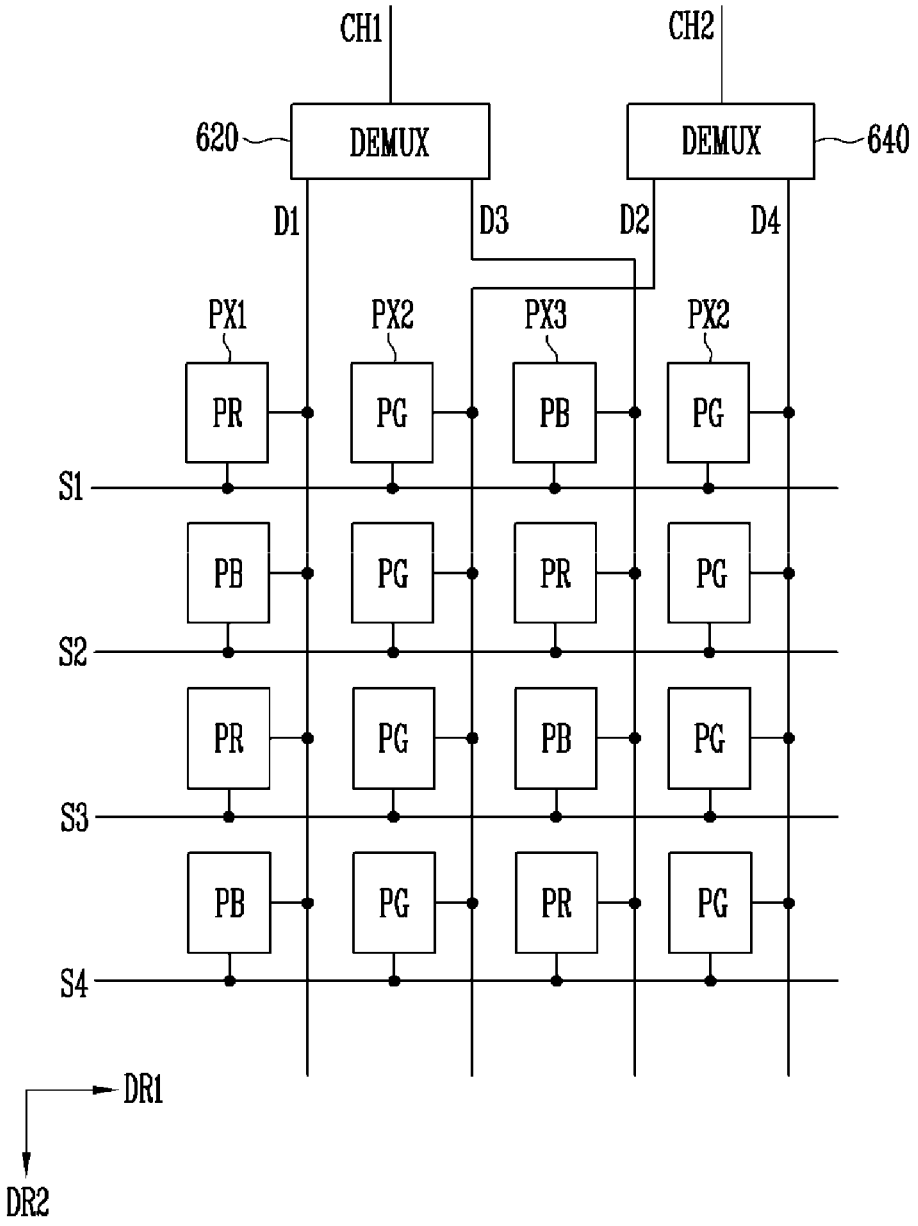
FIG. 11 is a diagram illustrating an example of a display panel and a data divider included in the display device of FIG. 10.

FIG. 11 is a diagram illustrating an example of a display panel and a data divider included in the display device of FIG. 10.

In FIG. 11, the same reference numerals may be used for the components described with reference to FIG. 2, and duplicate descriptions of these components will be omitted.

Referring to FIGS. 10 and 11, the display panel 100A may include a plurality of pixels PX1, PX2, and PX3, and scan lines S1, S2, S3, and S4 and data lines D1, D2, D3, and D4 connected to the pixels PX1, PX2, and PX3. The data divider 600 may include a first demultiplexer 620 and a second demultiplexer 640.

In an embodiment, the first demultiplexer 620 may time-division and supply data signals supplied from a first output channel CH1 to a first data line D1 and a third data line D3. For example, the data signals may be alternately supplied to the first data line D1 and the third data line D3 through the first demultiplexer 620. The first output channel CH1 may be electrically connected to red pixels PR and blue pixels PB. Accordingly, red data or blue data may be supplied to the first output channel CH1.

In an embodiment, the second demultiplexer 640 may time-division and supply data signals supplied from a second output channel CH2 to a second data line D2 and a fourth data line D4. For example, the data signals may be alternately supplied to the second data line D2 and the fourth data line D4 through the second demultiplexer 640. The second output channel CH2 may be electrically connected to green pixels PG. Accordingly, green data may be supplied to the second output channel CH2.

Figure 12:
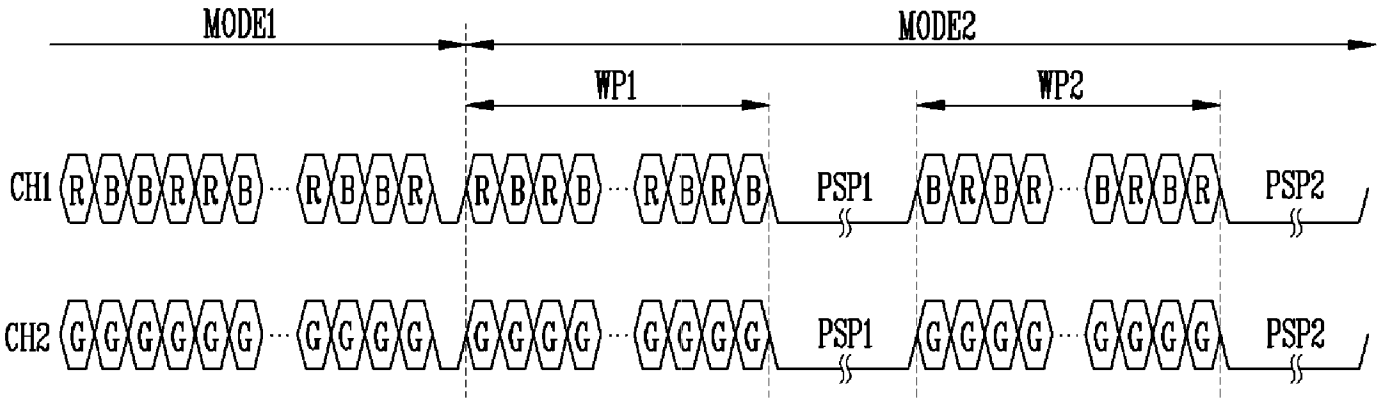
FIG. 12 is a diagram for explaining an example of data signals supplied to output channels of FIG. 11.

FIG. 12 is a diagram for explaining an example of data signals supplied to output channels of FIG. 11.

In FIG. 12, the same reference numerals may be used for the components described with reference to FIGS. 3 and 4, and duplicate descriptions of these components will be omitted.

Referring to FIGS. 3, 10, 11, and 12, a driving mode and a driving frequency of the display device 1000 may be changed, and a scan driving method may be changed corresponding to the driving mode. In addition, FIG. 12 shows a first mode MODE1 having a driving frequency of 60 Hz and a second mode MODE2 having a driving frequency of 30 Hz.

The data signals corresponding to the first data line D1 and the third data line D3 may be output to the first output channel CH1. The data signals corresponding to the second data line D2 and the fourth data line D4 may be output to the second output channel CH2. In the first output channel CH1, the data signals corresponding to odd-numbered image data may be supplied to the first data line D1, and the data signals corresponding to even-numbered image data may be supplied to the third data line D3. Similarly, in the second output channel CH2, the data signals corresponding to the odd-numbered image data may be supplied to the second data line D2, and the data signals corresponding to the even-numbered image data may be provided to the fourth data line D4.

In the first mode MODE1, the data signal may be output to the first output channel CH1 according to the arrangement order (arrangement type) of the image data of RBBR. The data signal of first red data R may be supplied to the first data line D1, and the data signal of first blue data B may be supplied to the third data line D3. The data signal of second blue data B may be supplied to the first data line D1, and the data signal of second red data R may be supplied to the third data line D3.

In the first mode MODE1, green data G may be output to the second output channel CH2. The data signals corresponding to odd-numbered green data G may be supplied to the second data line D2, and the data signals corresponding to even-numbered green data G may be supplied to the fourth data line D4.

One frame of the second mode MODE2 may include first and second writing periods WP1 and WP2 and first and second power saving periods PSP1 and PSP2.

In the first writing period WP1, odd-numbered pixel rows may be selected, and the data signal may be output to the first output channel CH1 in correspondence with the arrangement type of the image data of RBRB. Accordingly, the data signals of red data R may be supplied to the first data line D1 and the data signals of blue data B may be supplied to the third data line D3.

In the second writing period WP2, even-numbered pixel rows may be selected, and the data signal may be output to the first output channel CH1 in correspondence with the arrangement type of the image data of BRBR. Accordingly, the data signals of the blue data B may be supplied to the first data line D1 and the data signals of the red data R may be supplied to the third data line D3.

As described above, an arrangement of the image data corresponding to the first writing period WP1 of the first output channel CH1 may be different from an arrangement of the image data corresponding to the second writing period WP2 of the first output channel CH1. In addition, under the same input grayscale condition, a change in voltage of the data signals output to the first output channel CH1 in the first writing period WP1 may be different from a change in voltage of the data signals output to the first output channel CH1 in the second writing period WP2.

In the first and second power saving periods PSP1 and PSP2, supply of the scan signal and the data signal may be stopped.

Figure 13:
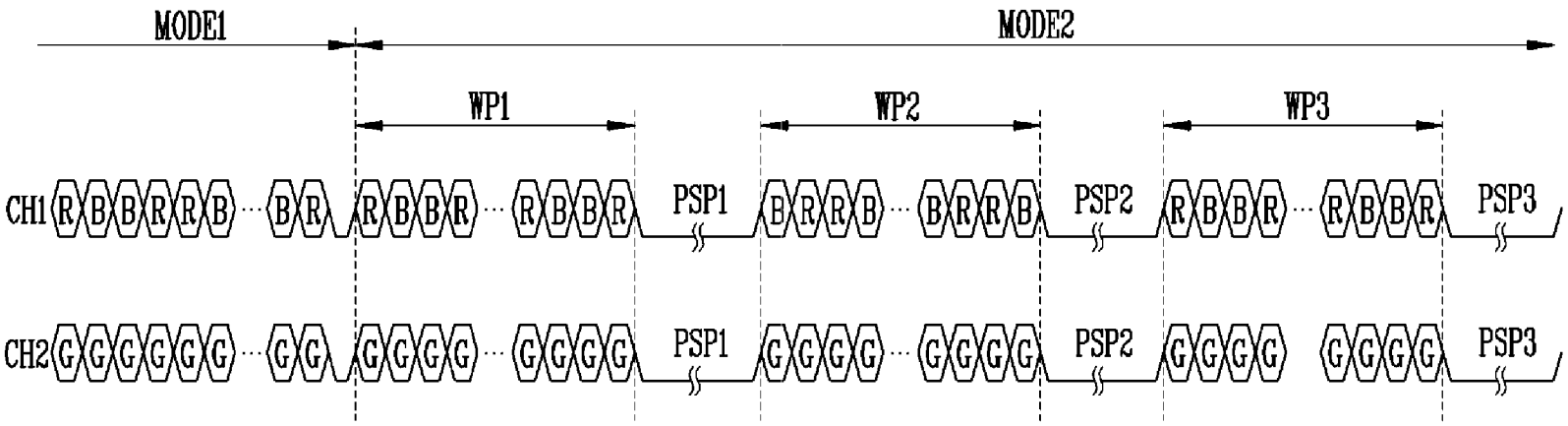
FIG. 13 is a diagram for explaining an example of data signals supplied to output channels of FIG. 11.

FIG. 13 is a diagram for explaining an example of data signals supplied to output channels of FIG. 11.

In FIG. 13, the same reference numerals may be used for the components described with reference to FIGS. 3, 4, and 12, and duplicate descriptions of these components will be omitted.

Referring to FIGS. 3, 10, 11, and 13, a driving mode and a driving frequency of the display device 1000A may be changed, and a scan driving method may be changed corresponding to the driving mode. In addition, FIG. 13 shows a first mode MODE1 having a driving frequency of 60 Hz and a second mode MODE2 having a driving frequency of 20 Hz.

One frame of the second mode MODE2 may include first to third writing periods WP1, WP2, and WP3 and first to third power saving periods PSP1, PSP2, and PSP3.

In the first writing period WP1, (3i−2)th pixel rows may be selected, and a data signal may be output to the first output channel CH1 in correspondence with the arrangement type of the image data of RBBR.

In the second writing period WP2, (3i−1)th pixel rows may be selected, and a data signal may be output to the first output channel CH1 in correspondence with the arrangement type of the image data of BRRB.

In the third writing period WP3, (3i)th pixel rows may be selected, and a data signal may be output to the first output channel CH1 in correspondence with the arrangement type of the image data of RBBR.

Accordingly, arrangements of the image data of adjacent writing periods of the first output channel CH1 may be different from each other. In addition, under the same input grayscale condition, a change in voltage of the data signals output to the first output channel CH1 in each of the adjacent writing periods may be different.

Figure 14:
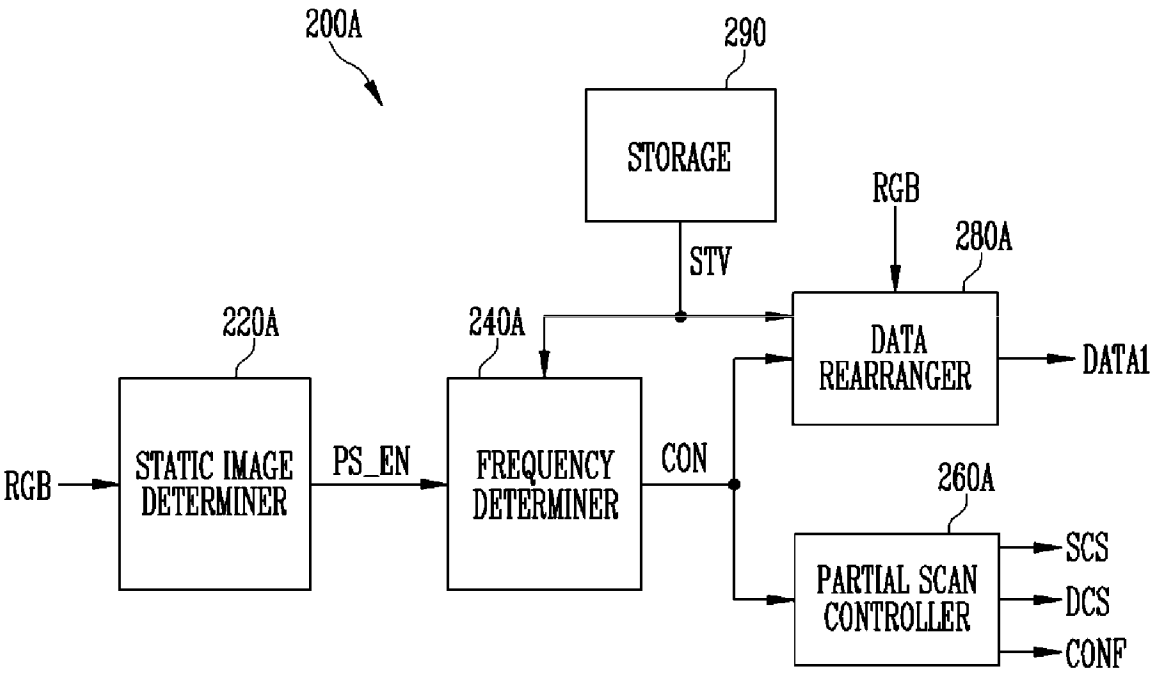
FIG. 14 is a block diagram illustrating an example of a controller included in the display device of FIG. 10.

FIG. 14 is a block diagram illustrating an example of a controller included in the display device of FIG. 10. FIG. 15 is a diagram illustrating an example of data outputs corresponding to setting values included in a storage of FIG. 14.

In FIG. 14, the same reference numerals may be used for the components described with reference to FIG. 6, and duplicate descriptions of these components will be omitted.

Referring to FIGS. 1, 10, 14, and 15, a controller 200A may include a static image determiner 220A, a frequency determiner 240A, a partial scan controller 260A, and a data rearranger 280A. In an embodiment, the controller 200A may further include a storage 290. That is, the static image determiner 220A may be electrically connected to the frequency determiner 240A, and the frequency determiner 240Amay be electrically connected to the data rearranger 280A and the partial scan controller 260A. Furthermore, the storage 290 may be electrically connected to the frequency determiner 240A and the data rearranger 280A.

In an embodiment, the storage 290 may include a storage in which option values STV including structure information and frequency information of the display panel 100 are stored. For example, the option values STV may be expressed as 3-bit information. An option value STV may include information on a driving mode, whether the data divider 600 is included (shown as No-mux/Demux in FIG. 15), and an arrangement type (or arrangement order) of image data determined based on the frequency information, and/or gamma application information.

For example, as shown in FIG. 15, the number of writing periods and the data signal output to the first output channel CH1 may vary according to a loaded option value STV. For example, when the option value STV is 001, the display device 1000A may be interpreted as including the data divider 600. In addition, in response to the option value STV of 001, data signals corresponding to the arrangement type of RBRB may be output in the first writing period, and data signals corresponding to the arrangement type of BRBR may be output in the second writing period.

When the option value STV is 010, data signals corresponding to the arrangement type of RBRB may be output in the first writing period, data signals corresponding to the arrangement type of BRBR may be output in the second writing period, and data signals corresponding to the arrangement type of RBRB may be output in the third writing period.

In an embodiment, the frequency determiner 240A may generate a control signal CON for controlling the partial scan controller 260A and the data rearranger 280A based on the option value STV loaded from the storage 290. The control signal CON may include information on the second frequency. The number of writing periods in the second mode MODE2 and the pixel rows (scan lines) selected in each of the writing periods may be determined by the second frequency.

The data rearranger 280A may rearrange the input image data RGB based on the loaded option value STV and the second frequency. An arrangement type of the image data output to the first output channel CH1 may be interpreted as shown in FIG. 15.

The partial scan controller 260A may generate configuration data CONF for determining an operation option of the data driver 400A based on the control signal CON generated based on the loaded option value STV. The control signal CON may include the information on the second frequency and the structure information of the display panel 100A. The configuration data CONF may include arrangement information of image data DATA1 corresponding to the second frequency and gamma application information corresponding to the image data DATAL However, this is an example, and a range of the second frequency and an input/output ratio of the data divider are not limited thereto. For example, the second frequency may further include various driving frequencies such as 10 Hz and 5 Hz. In addition, the input/output ratio of the data divider 600 may further include various ratios such as 1:3 and 1:4.

As described above, the controller 200A that can be applied to various structures and driving frequencies of the display panel 100A can be implemented by using the storage 290. Accordingly, versatility of the controller 200A can be improved, and the partial scan driving can be optimized under various conditions.

As described above, the display device according to the embodiments of the present disclosure may arrange the image data in different arrangement types in the first mode and the second mode in response to the partial scan driving in the second mode, and may apply different gamma sets to the output of the data signals corresponding to the odd-numbered data lines in the first mode and the second mode. Accordingly, in the partial scan driving of the display panel having a pixel structure as shown in FIG. 2, a gamma error (mismatch) in which the blue gamma (the red gamma) is incorrectly applied to the red data (the blue data) can be prevented, and the data signals can be optimized and output in each of the first mode and the second mode. Accordingly, both power consumption and image quality can be improved during the partial scan driving.

In addition, the display device may include a general-purpose controller that can be applied to various structures and driving frequencies of the display panel, so that the partial scan driving can be optimized under various conditions.

However, effects of the present disclosure are not limited to the above-described effects, and may be variously extended without departing from the spirit and scope of the present disclosure.

As described above, preferred embodiments of the present disclosure have been described with reference to the drawings. However, those skilled in the art will appreciate that various modifications and changes can be made to the present disclosure without departing from the spirit and scope of the disclosure as set forth in the appended claims.

What is claimed is:

1. A display device comprising:

a display panel driven in one of a first mode displaying an image at a first frequency and a second mode displaying an image at a second frequency lower than the first frequency;

a scan driver configured to sequentially supply a scan signal for writing data in the first mode to all pixel rows during a first frame corresponding to the first frequency;

a controller configured to generate image data in which input image data is rearranged based on the first mode or the second mode;

a gamma generator configured to provide a first gamma set corresponding to a first color, a second gamma set corresponding to a second color, and a third gamma set corresponding to a third color to a data driver; and the data driver configured to convert the image data into data signals using the first to third gamma sets and supply the data signals to output channels, wherein, in the second mode, the scan driver supplies the scan signal to at least some pixel rows, respectively, during writing periods of a second frame corresponding to the second frequency, and stops supplying the scan signal during power saving periods of the second frame, wherein the data driver is configured to supply first parts of the data signals to a first output channel of the output channels using a first gamma group including one or more of the first to third gamma sets in a first writing period of the writing periods, and to supply second parts of the data signals to the first output channel using a second gamma group including one or more of the first to third gamma sets in a second writing period of the writing periods, and wherein the gamma sets of the second gamma group has a sequence different from that of the gamma sets of the first gamma group.

2. The display device of claim 1, wherein the controller generates the image data according to an order in which the pixel rows are selected during the writing periods of the second mode.

3. The display device of claim 1, wherein the image data of the first frame is arranged in a first arrangement type, and wherein the image data of the second frame is arranged in a second arrangement type.

4. The display device of claim 1, wherein the data driver applies the first, second, and third gamma sets to the image data in correspondence with a first arrangement type in the first mode, and wherein the data driver applies the first, second, and third gamma sets to the image data in correspondence with a second arrangement type in the second mode.

5. The display device of claim 2, wherein the data driver stops outputting the data signals during the power saving periods.

6. The display device of claim 5, wherein each of the writing periods is shorter than a period of the first frame.

7. The display device of claim 2, wherein the display panel includes: a first pixel row in which a first pixel emitting light of the first color, a second pixel emitting light of the second color, a third pixel emitting light of the third color, and the second pixel are arranged in a first direction; a second pixel row in which the third pixel, the second pixel, the first pixel, and the second pixel are arranged in the first direction;

a third pixel row having an equal pixel arrangement to the first pixel row; and a fourth pixel row having an equal pixel arrangement to the second pixel row.

8. The display device of claim 7, wherein the power saving periods include first and second power saving periods.

9. The display device of claim 7, wherein the scan driver supplies the scan signal to different pixel rows in each of the first and second writing periods.

10. The display device of claim 2, wherein the controller includes:

a static image determiner configured to detect a static image by comparing the input image data of successive frames;

a frequency determiner electrically connected to the static image determiner and configured to activate the second mode based on a detected static image and determining the second frequency;

a partial scan controller electrically connected to the frequency determiner and configured to generate a scan control signal and a data control signal for controlling the scan driver and the data driver in the writing periods and the power saving periods based on the second frequency; and a data rearranger electrically connected to the frequency determiner and configured to rearrange the input image data based on the second frequency.

11. The display device of claim 9, wherein an arrangement of the image data corresponding to the first writing period of the first output channel is different from an arrangement of the image data corresponding to the second writing period of the first output channel.

12. The display device of claim 11, wherein, under a same input grayscale condition, a change in voltage of the data signals output to the first output channel in the first writing period is different from a change in voltage of the data signals output to the first output channel in the second writing period.

13. The display device of claim 11, wherein a second output channel among the output channels is connected to the second pixel, and wherein the data signals corresponding to the second color are output to the second output channel during the period of the first frame and the writing periods.

14. The display device of claim 11, further comprising:

a data divider configured to connect the output channels to data lines which is connected to pixel columns of the display panel by 1:j (wherein j is an integer greater than 1).

15. The display device of claim 14, wherein the data divider alternately supplies the data signals supplied from the first output channel to a first data line and a third data line, and wherein the data divider alternately supplies the data signals supplied from a second output channel to a second data line and a fourth data line.

16. A display device comprising:

a display panel driven in one of a first mode displaying an image at a first frequency and a second mode displaying an image at a second frequency lower than the first frequency;

a scan driver configured to sequentially supply a scan signal for writing data in the first mode to all pixel rows during a first frame corresponding to the first frequency;

a controller configured to generate image data in which input image data is rearranged based on the first mode or the second mode; and a data driver configured to convert the image data into data signals and supply the data signals to output channels, wherein, in the second mode, the scan driver supplies the scan signal to at least some pixel rows, respectively, during writing periods of a second frame corresponding to the second frequency, and stops supplying the scan signal during power saving periods of the second frame, wherein the controller includes:

a static image determiner configured to detect a static image by comparing the input image data of successive frames;

a frequency determiner electrically connected to the static image determiner and configured to activate the second mode based on a detected static image and determining the second frequency;

a partial scan controller electrically connected to the frequency determiner and configured to generate a scan control signal and a data control signal for controlling the scan driver and the data driver in the writing periods and the power saving periods based on the second frequency;

a data rearranger electrically connected to the frequency determiner and configured to rearrange the input image data based on the second frequency; and a storage storing option values having structure information and frequency information of the display panel, wherein the frequency determiner determines the second frequency based on a value loaded from the storage, and wherein the data rearranger rearranges the input image data based on the value loaded from the storage and the second frequency.

17. The display device of claim 16, wherein the partial scan controller generates configuration data for determining an operation option of the data driver based on the second frequency and the structure information of the display panel, and wherein the configuration data includes arrangement information and gamma application information of the image data corresponding to the second frequency.

* * * * *